United States Patent [19]

Horton

[11] 4,374,568

[45] Feb. 22, 1983

[54] COMPOSITE CONTAINER WITH COMPRESSED BODY WALL PORTION

[75] Inventor: John D. Horton, Hartsville, S.C.

[73] Assignee: Sonoco Products Company, Hartsville, S.C.

[21] Appl. No.: 316,444

[22] Filed: Oct. 29, 1981

Related U.S. Application Data

[62] Division of Ser. No. 234,191, Feb. 13, 1981.

[51] Int. Cl.[3] ..... B65D 3/10

[52] U.S. Cl. ..... 229/5.5

[58] Field of Search ..... 229/5.5, 37 E, 2.5 R, 229/5.6, 5.8; 220/66, 67, 266, 277; 138/96 R, 96 T, 109, 177, 178

[56] References Cited

U.S. PATENT DOCUMENTS

| | | | |
|---|---|---|---|
| 1,748,865 | 2/1930 | Chaplin | 229/2.5 R |
| 3,244,313 | 4/1966 | Miles | 229/2.5 R |
| 3,397,809 | 8/1968 | Ellerbrock | 220/277 |
| 3,401,863 | 9/1968 | Earl | 229/2.5 R |
| 3,608,774 | 9/1971 | Saunders | 220/67 |

FOREIGN PATENT DOCUMENTS

| | | | |
|---|---|---|---|
| 193787 | 12/1957 | Austria | 229/5.5 |
| 768262 | 2/1957 | United Kingdom | 229/5.6 |

*Primary Examiner*—Herbert F. Ross

*Attorney, Agent, or Firm*—Dennison, Meserole, Pollack & Scheiner

[57] ABSTRACT

A composite can construction wherein the body wall, adjacent either one or both cap receiving ends thereof, is inwardly compressed to reduce the outside diameter of the tubular body while maintaining the inside diameter. The compression, reducing the thickness of the body wall, also densifies the material thereof without affecting the interior of the container or the structural integrity thereof. The compressed area extends along the length of the container body a distance sufficient to project substantially beyond the bead formed as a metal end cap is seamed to the body, thus providing a recess for facilitating accommodating of the driving wheel of a conventional can opener. The formed bead, utilizing the pre-compressed body portion and the denser material thereof, is relatively narrower and stiffer than the bead conventionally obtained upon the sealing of a metal end cap to a composite tubular body.

5 Claims, 9 Drawing Figures

Prior Art

COMPOSITE CONTAINER WITH COMPRESSED BODY WALL PORTION

This application is a division of application Ser. No. 234,191, filed Feb. 13, 1981.

BACKGROUND OF THE INVENTION

The invention is basically concerned with composite cans or containers utilizing tubular bodies of at least one, and normally multiple, plies of cardboard, paperboard, or the like spirally or convolutely wound to define a rigid self-sustaining body to which metal end caps are seamed.

Such containers have found wide acceptance, and, as the various problems of moisture impermeability, air tightness, and the like are being solved, are increasingly used as a highly desirable substitute for the more conventional metal container or can.

However, one significant problem which still exists with regard to the use of composite cans, particularly those with what might be considered heavy walls, that is walls with a thickness of 0.030 inch or greater, is the substantial difficulty encountered in opening such containers using the conventional manual or electric can openers found in substantially every home. This problem has heretofore been recognized, and is in fact discussed in great detail in U.S. Pat. No. 3,397,809, issued to Donald H. Ellerbrock on Aug. 20, 1968.

Basically, fiber composite can body walls are softer, more compressible and thicker than the metal walls used in conventional metal cans. Thus, upon seaming a metal lid to a composite body, the resultant seam or bead is both thicker and softer or more readily compressible than the same seam on a metal can. While the conventional can opener, made to accommodate conventional metal cans, can be canted to engage the thicker seam or bead on a composite can, this frequently causes an improper and ineffective engagement of the cutting blade and/or drive wheel of the can opener. Attempts to sufficiently engage the can opener with a composite container seam for a proper opening of the container results, in many instances, in an unsightly and destructive tearing of the outer or label ply of the container. Finally, even when fully engaged with the seam or bead, effecting sufficient clamping of the can opener to the container to pierce the cap and progressively sever the cap from the bead as the can opener is driven thereabout frequently results in merely crushing the bead. Such crushing of the bead results from an inability of the bead or seam to sustain the normal forces required to drive the opener in that the bead or seam includes the interposed relatively soft and compressible composite material of the body end, as opposed to the substantially stronger solid metal seam encountered in metal containers. Ellerbrock proposes a solution to the problem of accommodating a composite container to a conventional can opener by modifying the metal cap or end by providing a pre-weakened circumferential area immediately inward of the bead or seam to reduce the resistance to cutting and thus the driving force required by the driving wheel. While the Ellerbrock proposal may facilitate the opening of composite containers, the retained thick seam still requires substantial canting of the opener, and an accompanying rather severe scuffing or cutting of the body wall immediately below the bead.

SUMMARY OF THE INVENTION

The invention herein is directed to a composite container, and the manner of forming the container, wherein the tubular composite body incorporates a compressed wall section adjacent one or both ends thereof within and for a substantial distance beyond that portion of the wall which is to be seamed to the end cap. The compressed wall section extends circumferentially around the body and is compressed in a manner whereby the uniformity of the inside diameter of the body is maintained while the outside diameter of the body is decreased. The material within the compressed section or portion of the wall is densified, and thereby strengthened in the sense that the compressibility thereof is reduced.

Subsequent to compressing the wall end section, the end cap is applied with the peripheral flange thereof and the corresponding compressed end section formed or rolled into a sealing bead peripherally about the container. The formed bead, incorporating the relatively narrower and denser body section, is both thinner and stiffer or stronger than the conventional bead obtained on a composite container. This in turn enables substantially better accommodation of a can opener to the bead, as well as much improved resistance to bead crushing during application and operation of the can opener. Further, the compressed wall section of the tubular body extends a substantial distance longitudinally below the formed bead to provide a recessed area as an additional accommodation to the driving wheel of the can opener. In this manner, proper engagement of the driving wheel with the undersurface of the bead, without scuffing or tearing engagement with the outer surface of the body, is provided.

As noted above, the compressing of the wall is effected as a preliminary step prior to the application of the can end and forming of the sealing seam.

DESCRIPTION OF THE PREFERRED EMBODIMENT

Figure 1:
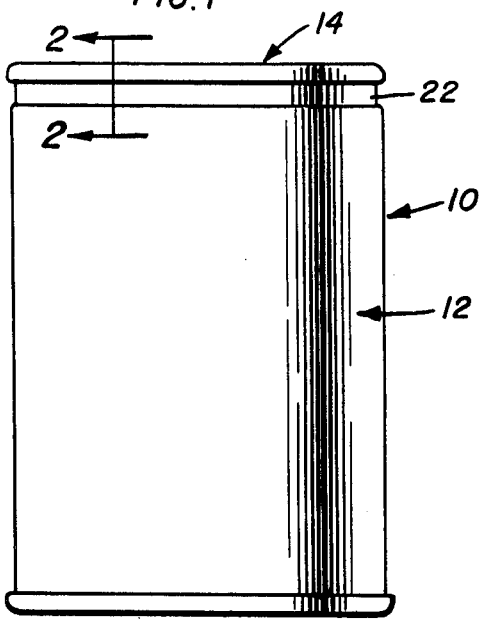
FIG. 1 is an elevational view of a composite container constructed in accordance with the present invention.

Referring now more specifically to the drawings, reference numeral 10 is used to generally designate a container formed in accordance with the present invention. This container includes a tubular composite body 12, preferably formed of multiple spirally wound plies of paperboard or the like, and a pair of opposed metal end caps 14, seamed to the opposed ends of the tubular body 12.

The invention herein is concerned with facilitating the opening of a capped composite container utilizing a conventional can opener. While such containers can be, and sometimes in fact are, opened from the opposite ends thereof, it is generally accepted that a container, whether it be a metal can or a metal capped composite container, be opened from or through the top end. Accordingly, while the features of the present invention are equally adaptable for both ends of a composite container, and may, as a matter of choice, be applied to both ends, for purposes of illustration, the description herein shall be directed to a single end of the container.

Figure 7:
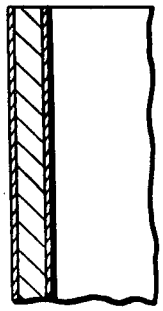
FIGS. 7–9 schematically illustrate the conventional procedure for seaming an end cap to a composite container.
Figure 8:
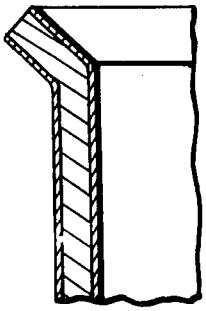
Prior Art FIG. 8
Figure 9:
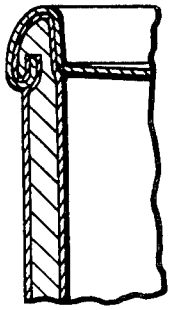
Prior Art FIG. 9

Attention is initially directed to FIGS. 7, 8 and 9, which sequentially illustrate the steps involved in conventionally securing a metal end cap to a tubular composite container body. FIG. 7 illustrates the upper end portion of the tubular body as it initially appears prior to any forming thereof for the accommodation of the cap. FIG. 8 illustrates the flaring of the end portion of the tubular body prior to positioning the metal end cap thereon. FIG. 9 illustrates the end cap seamed to the composite can body. This seaming is conventionally effected by sequentially rolling and forming the flared end portion of the body and the overlying end cap peripheral flange into a generally outwardly and downwardly curling beaded configuration. While some compression of the end portion of the tubular body occurs during the seaming operation, the resultant bead or seam is still substantially thicker and more readily compressible than that achieved in a conventional metal container wherein both the tubular body and the cap are of metal. It is such metal containers that the conventional readily available can opener is intended to accommodate.

In order to produce a capped composite container, and more particularly an end cap securing bead or seam, which can be conveniently opened by a conventional can opener without slippage, crushing of the bead, tearing of the outer label, and the like, all of which are significant problems presently encountered in the use of composite containers, the present invention proposes a modified tubular body construction and a modified procedure whereby the end caps are secured to the tubular bodies.

The bead or seam proposed by the present invention, and formed by the application of a metal end cap to the end portion of a composite tubular body, produces, in the thinness thereof, and the increased compressible strength thereof, a much closer approach to the seam achieved in a conventional metal container, and one which is completely compatible with conventional can openers. In other words, the seam formed in accordance with the present invention avoids the significant problems heretofore associated with conventional metal capped composite containers.

The advantages of the present invention are basically achieved by compressing an end section 16 of the tubular body to provide a portion which is both thinner and more dense than the main wall 18 of the tubular body 12. The compression of the body wall in the section 16 will be effected from the exterior of the tubular body, producing a reduction in the outside diameter of the body while maintaining the inside diameter. This has several advantages, including maintaining the interior of the formed container uniformly smooth and without a step or shoulder, an avoidance of any tendency to disrupt any internal liner or lining material provided, and the provision of an exterior recess circumferentially about the container immediately below the formed bead to enable more proper engagement of the can opener drive wheel with the bead, as shall be described in detail subsequently.

Figure 5:
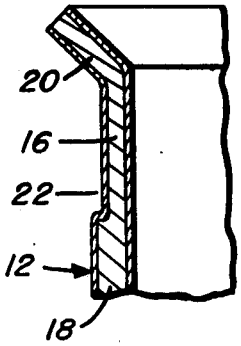

The step of compressing the end section 16 of the tubular body 12 will, in the sequence of FIGS. 3–6, occur prior to flaring the end of the body, as noted at 20 in FIG. 5, which flaring is preparatory to applying and seaming the cap 14 to the composite body. Incidentally, a further advantage to maintaining the uniformity of the internal diameter of the body is a retention of the ability of the body to accommodate a standard lid or cap, the pin or centrally depressed portion of which is received within the end of the tubular body.

Figure 2:
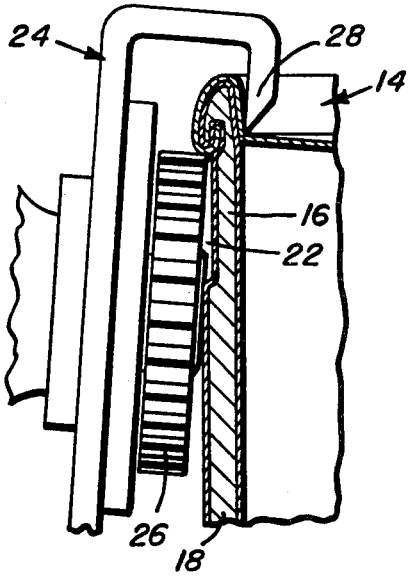
FIG. 2 is an enlarged cross sectional detail taken substantially on a plane passing alone line 2—2 in FIG. 1 with a can opener illustrated in operative position.
Figure 3:
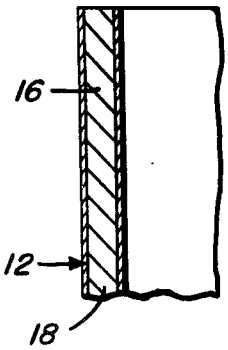
FIGS. 3–6 schematically illustrate the sequence involved in forming the end of a tubular body and sealing an end cap thereto in accordance with the present invention.
Figure 4:
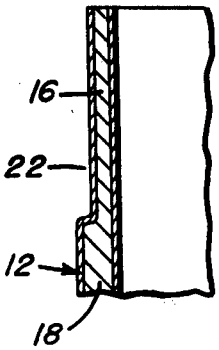
Figure 6:
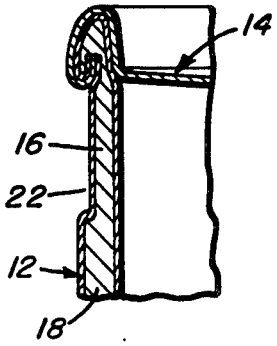

It is contemplated that the pre-compression of the tubular body wall produce a final seam, as in FIGS. 2 and 6, which has a thickness no greater than 0.085 inches. This provision of a compressed wall section will be of particular utility in composite containers wherein the body wall is in excess of 0.030 inch in that while walls of such thickness are commonly used for the packaging of many different products, the above described problems in the use of conventional can openers are quite prevalent. It is preferred that the height of the compressed wall portion 16, before seaming, be approximately 5/16 inch. This in turn will leave an exposed compressed area, below the bead, of approximately $\frac{1}{8}$ inch. This exposed compressed area will be noted at 22 in FIGS. 1, 2 and 6. The provision of this exposed compressed area or external circumferential recess 22 is significant in insuring proper orientation and engagement of the can opener 24 with the driving wheel 26 below the bead and the cutting blade 28 adjacent the inner face of the bead without excess canting of the can opener and generally in the manner of engagement with a conventional all metal container. As suggested in FIG. 2, the engagement of the drive wheel with the now formed thin stiffened bead can be effected without biting or scuffing engagement of periphery of the wheel with the exterior surface of the tubular body 18.

The actual seam locking of the metal can end or cap to the compressed composite body wall can be effected in a conventional manner using conventional seaming rolls to simultaneously engage and outwardly roll or curl the end cap flange and flared portion 20 of the compressed section 16 of the body wall 18. It should also be pointed out that the provision of the compressed wall section 16 at one or both ends of the tubular body 12 does not adversely affect the structural integrity of the container in that the end caps themselves provide substantial additional strength and rigidity directly at the ends of the tubular bodies.

From the foregoing, it will be appreciated that a unique solution has been found for enabling the construction of metal-capped composite containers which can be properly and efficiently opened by the substantially universally available forms of manual or electric can openers, most of which are particularly designed for use in conjunction with all metal containers. This is achieved by specifically compressing the body wall, in the area of the seam, prior to the actual seaming to achieve both a substantially narrower seam and a substantially stronger or less easily crushed seam, thus approximating the thinness and strength of an all metal seam. In addition, the compressed area is extended along the container wall sufficiently to create a substantial recess below the formed seam to facilitate proper engagement of the can opener with the seam without excess canting of the can opener or destructive or defacing engagement thereof with the body wall.

The foregoing is illustrative of the principles of the invention. As modifications or variations in the construction and procedure described may occur to those skilled in the art, it is to be appreciated that all such modifications and variations may be resorted to within the scope of the invention as claimed.

I claim:

1. In a composite container constructed particularly for the accommodation of the cutting blade and drive wheel of a conventional can opener, a composite wall defining a tubular body with opposed ends, said wall, along a circumferential section of the tubular body adjacent at least one of said ends, being inwardly compressed and densified, defining a wall portion both thinner than and of a greater density than the remainder of said wall, said circumferential section having an internal diameter equal to the internal diameter of the remainder of said tubular body, a metal end cap overlying said one of said ends, said end cap including a peripheral flange seamed to said wall portion to define a peripheral sealing bead, said circumferential section and said wall portion defined thereby extending a substantial distance along said tubular body beyond said bead to define an external recess peripherally about said body.

2. The container of claim 1 wherein said recess extends beyond said bead a distance greater than the height of said bead.

3. For use in the formation of a composite container, a tubular body defined by a composite wall, said body having opposed ends, said composite wall, adjacent at least one of said ends, being inwardly compressed and densified to define a wall portion both thinner than and of greater density than the remainder of said wall for engagement by and seaming to a metal end, said tubular body, at said wall portion, having an internal diameter equal to the internal diameter of the tubular body defined by the remainder of said wall.

4. The construction of claim 3 wherein said wall portion is of a height, longitudinally along said tubular body, of approximately 5/16 inch.

5. The container of claim 2 wherein said composite wall is defined by multiple plies of a paperboard product.

* * * * *